United States Patent [19]

Bussi et al.

[11] 3,945,931

[45] Mar. 23, 1976

[54] UTILIZATION OF AMIDO-ACIDS FOR THE PRODUCTION OF AQUEOUS FLUIDS FOR THE WORKING OF METALS

[75] Inventors: Giancarlo Bussi; Pierpaolo Baradel, both of Trieste, Italy

[73] Assignee: Aquila S.P.A., Trieste, Italy

[22] Filed: Oct. 18, 1974

[21] Appl. No.: 516,030

[30] Foreign Application Priority Data

Oct. 18, 1973 Italy ..... 30278/73

[52] U.S. Cl. ..... 252/32.5; 72/42; 252/33.6; 252/49.3

[51] Int. Cl.[2]. C10M 1/44; C10M 3/38; C10M 5/24; C10M 7/24

[58] Field of Search..... 252/32.5, 33.6, 49.3; 72/42

[56] References Cited

UNITED STATES PATENTS

| | | | |
|---|---|---|---|
| 3,277,001 | 10/1966 | Fischer et al. | 252/49.3 |
| 3,313,728 | 4/1967 | Glasson et al. | 252/49.3 |
| 3,556,994 | 1/1971 | Diery et al. | 252/33.6 |
| 3,574,100 | 4/1971 | Wetmore | 252/32.5 |
| 3,766,068 | 10/1973 | Lesdahl et al. | 252/33.6 |

*Primary Examiner*—Delbert E. Gantz
*Assistant Examiner*—I. Vaughn
*Attorney, Agent, or Firm*—Haseltine, Lake & Waters

[57] ABSTRACT

An aqueous fluid for the working of metals comprising ar. aqueous solution of at least one salt of an amido acid of the formula:

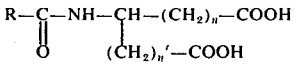

in which R is a hydrocarbon group, substituted or not by chlorine, and having between 9 and 25 carbon atoms; $n$ and $n'$ are whole numbers or zero, identical or not, whose sum $(n + n')$ is equal to 1 or 2.

7 Claims, No Drawings

UTILIZATION OF AMIDO-ACIDS FOR THE PRODUCTION OF AQUEOUS FLUIDS FOR THE WORKING OF METALS

FIELD OF THE INVENTION

The present invention relates to products which are utilized in the working of metals in processes involving production of chips of material, such as cutting and milling, for example, or of deformation processes without production of chips such as rolling, stretching and drawing for example. The invention relates, more particularly, to chemical compositions which, in aqueous solution, constitute bases for the formulation of liquids for the working of metals. These bases can generally be utilized alone or after having been mixed with relatively small quantities of additives, to serve one or a plurality of particular functions of aqueous fluids.

PRIOR ART

It is known that aqueous fluids utilized for the working of metals should have a number of properties among which can be mentioned: anti-corrosion power, the property of biodegradability and for certain operations, lubrication capability. Some other properties which can also be cited are the absence of formation of foam at the time of utilization, non-toxicity and absence of odor. Finally, it is suitable if the products are inexpensive.

A number of fluids already exist in the market which possess these properties in various degrees, however many of these fluids are not aqueous solutions but are oil emulsions in water, but the characteristic principle of these fluids is that it is a matter of compositions of materials including a large number of very diverse materials each of which possess a particular property which it is desired to confer to the fluid. A certain number of these fluids, known in commerce under the name of "Synthetics for Mechanical Working" are aqueous solutions generally containing between 30 and 70% of a main constituent such as the condensates of alkylene oxides, soaps, corrosion inhibitors and foams, "high pressure" additives, etc. These products are generally now biodegradable and, additionally, impose on the manufacturer, complex operations to maintain their solubility and their particular properties. Additionally, they do not possess high pressure lubrication properties.

SUMMARY OF THE INVENTION

An object of the present invention is the realization of new bases for the preparation of aqueous fluids destined for application to working metal, said bases being utilized in aqueous solution, as is, without additives or in the presence of additives and having the properties which have been mentioned above.

A further object of the present invention is the provision in the utilization in aqueous fluids for the working of metal, alkaline salts and/or amine salts and/or water soluble ammonium salts of the products of condensation of a fatty acid and a dicarboxylic amino acid.

Among the condensation products cited above, the amido acids of the general formula $$R-CO-NH-\underset{\underset{(CH_2)_{n'}-COOH}{|}}{CH}-(CH_2)_n-COOH$$

are particularly suitable. In the formula, R is an open chain aliphatic hydrocarbon group, substituted or not by chlorine, having between 9 and 25 carbon atoms; $n$ and $n'$ are whole numbers or zero, the same or not, the sum of $n$ and $n'$ being equal to 1 or 2.

A further object of the present invention is the production of new bases for aqueous fluids adapted to the working of metals, of mixtures of:

Alkali metal salts and/or amine salts and/or ammonium salts, soluble in water, of the condensation products of a fatty acid and a dicarboxylic amino acid such as defined above.

alkali metal salts and/or amine salts and/or ammonium salts, soluble in water, of orthophosphoric mono- and/or diesters of fatty alcohols and/or of fatty acid-alcohols, said esters comprising chlorine atoms in the carbon chain of their molecule.

The formula of the mono-and diesters are the following:

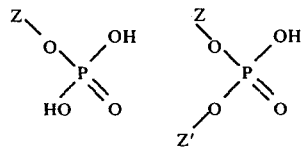

monoester diester wherein Z and Z' are identical or not; they are open chain aliphatic groups containing between 10 and 20 carbon atoms; the chlorine atoms are attached thereto.

These mono-and diesters are described in our copending application of even date and in Italian Application E.N. 30.279. A/73, filed Oct. 18, 1973. Therein it is disclosed that the fatty alcohols used in the synthesis of these esters can have the general formula $Y\text{-}CH_2OH$ in which Y is a linear unsaturated chain having 9 to 19 carbon atoms; it can be practically pure such as oleic acid for which Y is 17 atoms of carbon and a double bond in 9 position or a mixtureof alcohols of the general formula $Y\text{-}CH_2OH$.

The alcohol can also have an acid function such as ricinoleic acid of the formula:

$$Ch_3\text{-}(CH_2)_5\text{-}CHOH\text{-}CH_2\text{-}CH{=}CH\text{-}(CH_2)_7\text{-}COOH$$

The method for the synthesis of these esters is described in the above-noted Applications.

The Applicants have found that the mixture of two types of products (salts of amido-acids and salts of phosphoric esters) are particularly desirable for obtaining aqueous fluids for use with working metals. For this particular application, the production of these mixtures is made in the same manner as that of the salts of te amido-acids taken alone and which will be described later; the two types can be mixed in all proportions, each of the two types possessing, individually, beneficial properties for this application as will be seen later for the amidoacid salts and as is explained in the aforementioned Application for the ester salts. Thus, the two types can be mixed in proportions varying from 0 to 100% by weight.

A still further object of the invention is constituted by a method of synthesizing the aqueous fluids described hereinabove. The method is characterized in that it comprises the following steps:

a. chloration, by addition, to the chain of a fatty acid having 10 to 26 carbon atoms, b. preparation of the chloride of the fatty acid whose chain has been saturated by chlorine, c. condensation of the chloride of the fatty acid with an alkali metal salt and/or an amine salt, and/or an ammonium salt of a dicarboxylic amino acid;

d. Salification of the resulting amido acid with an alkaline base and/or an amine and/or ammonia.

The fatty acid of the general formula R'-COOH in which R' is straight and unsaturated and has 9 to 25 carbon atoms, can be substantially pure, such as oleic acid, stearic acid or it can be a mixture of fatty acids such as tall oil (which comprises about 75% of oleic acid) or resinic acids, oleins of fish oil and of general type animal and vegetable oleins, and natural and synthesized fatty acids.

The dicarboxylic amino-acid has the formula

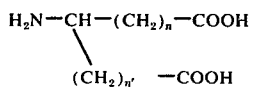

in which $n$ and $n'$ are whole numbers or zero, the same or not, such that the sum of $n$ and $n'$ is equal to 1 or 2. The dicarboxylic amino-acid can be constituted of a single constituent such as aspartic acid (for which $n=0$ and $n'=1$) or of a mixture of amino acids such as natural amino acids obtained by the hydrolysis of proteins.

A further object of the invention is constituted, as new industrial products, of the salts of the general formula

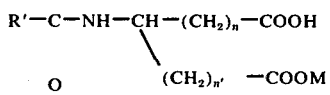

and aqueous solutions thereof, in which:

R' is a hydrocarbon group substituted by chlorine and having 9 to 25 carbon atoms $n$ and $n'$ are whole numbers or zero, the same or not, such that the sum of n and n' is equal to 1 or 2.

M is selected from the group consisting of alkaline metals, the ammonium radical $(NH_4)^+$ and substituted ammonium radicals derived from amines.

Finally, a last object of the invention is constituted, of new compositions and industrial products, in aqueous solution of:

Alkali metal salts and/or amine salts and/or ammonium salts soluble in water of the condensation products of a fatty acid and a dicarboxylic amino acid in admixture in any proportion with:

alkali metal salts and/or amine salts and/or ammonium salts, soluble in water, of the orthophosphoric mono- and/or diesters of fatty alcohols and/or fatty acid-alcohols, said esters having chlorine atoms in the carbon chain of their molecule.

The Applicants have in fact established the utility for the utilization of the products or mixtures described above in the realization of aqueous fluids for the working of metals. To obtain the amido-acid salts of which it will be a question of the preparation hereafter, in the case where one starts with a fatty acid which is not substituted by chlorine, the alkali metal salts and the amine salts and/or the ammonium salt of the obtained amido acid have the excellent properties of water solubility and anti-corrosion. In the case where there is a chlorine substitution in the hydrocarbon chain of the fatty acid utilized, the salts finally obtained posess additionally the property of lubrication at high pressure.

The process for preparation of the two types of products, chlorinated or non-chlorinated, are identical as regards the three last steps. In the case where one desires to utilize a chlorinated fatty acid, it is simply necessary to add preliminarily to the three preceding steps, the step of chlorination. These four steps are described hereafter.

The preliminary step (in the case in which chlorinated fatty acids are desired) is the chloration of the fatty acid. This step is intended to effect the addition of a molecule of chlorine by double bond with a carbon atom in the molecule of the fatty acid. The conditons of this reaction are known: one operates on the product in non-diluted state, or in the presence of a solvent of the fatty acid (hexane, chloroform, for example) by bubbling gaseous chlorine therethrough at a suitable temperature according to the reactivity and the stability of the charge (generally close to ambient temperature). After the reaction, the excess chlorine can be removed, either by passage of a gas such as nitrogen or air in the solvent, or by washing with water. The fatty acid obtained comprises as many chlorine atoms as the number of ethylenic unsaturations initially contained in the acid.

After this preliminary step, necessary only in the case where it is desired to start with a chlorinated fatty acid, the following three steps are applicable to the case of chlorinated fatty acids and to those in which the fatty acids are not chlorinated.

The first main step of the process is the preparation of the chloride of the fatty acid, chlorinated or not. This preparation is also effected according to conventional techniques in the art, i.e. the acid is put into solution in a solvent (for example a saturated hydrocarbon), then it is put into contact with the penta- or trichloride of the fatty acid, such as thionyl chloride ($SO\ Cl_2$); the mixture is reacted under reflux for about 2 hours. It is allowed to cool and the non-reacted excess is removed along with secondary reaction products by means suitable for the chlorine agent.

The second principal step of the process is the condensation of the chloride of the fatty acid, chlorinated or not, and the amino acid with elimination of hydrochloric acid. This is also a well known reaction. In practice, small quantities are reacted at one time, of an aqueous solution, with optional addition of acetone, with an amino-acid salt (such as the salt of sodium used by reason of its solubility in the fatty acid chloride (chlorated or not) in solution in ether, for example). The reaction is effected at ambient temperature, the freed acid is neutralized by the addition of sodium hydroxide such that the pH is maintained at about 10. The temperature can be raised at the end of the reaction. The amido acid is extracted by an appropriate solvent which is then evaporated or separated by other means such as filtration, centrifugation, etc.

The third principal step of the process of synthesis is constituted by the salification of the thus obtained amidoacid by means of an alkaline base such as sodium hydroxide, potassium hydroxide, lithia, or ammonia, or an amine such as triethanolamine or morpholine. In general the base or amine is utilized in excess, this excess being, without disadvantage, equal to more than two times stoichiometric.

For example, if the fatty acid is chlorinated oleic acid, the amino-acid is aspartic acid and sodium hydroxide is the alkaline base, the amido-acid salt has the following chemical formula:

$$CH_3-(CH_2)_7-CHCl-(CH_2)_7-\underset{\underset{O}{\|}}{C}-NH-\underset{\underset{CH_2-COON_a}{|}}{CH}-COON_a$$

The products thus obtained or their mixtures with the salts of phosphoric esters, described above, can be sold for a suitable utilization in a 10 – 70% aqueous solution and the buyer can make the final dilution at the concentration to be used, which in general is between 1 and 10%.

Additionally, in order to perfect the characteristics of te employed product, it is possible to add an additive thereof such as

- anti-foam agents
- bactericides
- anti-corrosive agents
- odor additives
- colorants
- agents to modify the physical characteristics.

The anti-foaming agents can be silicones, esters and special soaps.

Phenols, quatenary ammonium salts, nitrogen derivatives of alcohols, thiocarbonates, thiocarbamate, etc. which are known bactericides can be utilized herein.

The anti-corrosive agent can be alkaline nitrates, phosphates, borates, etc.

As odor control additives or colorants there can be used any of many conventional substances available in the marketplace.

Finally, the agents for the modifications of the physical properties of the product can be alcohols, glycols, etc. which have been used conventionally as viscosity additives which are useful in aqueous solution or as is.

The properties of these fluids can be determined by means of diverse methods. Applicant has determined the solubility in water by centrifugation of the aqueous solution and measuring the volume of the sediment; the anti-corrosive power by the IP 125 standard; the lubrication power in the case of chlorinated products by the standard of ASTM D 2783-69 T; the biodegradability by the relation of the biological oxygen demand of an aqueous solution in a given time (ASTM D 2329 - 68), to the chemical oxygen demand (ASTM D 1252 - 67) which is a measure of the necessary quantity of oxygen for complete oxidation for the same quantity of aqueous solution.

The present invention is additionally illustrated by the following examples, which are given in non-limiting fashion.

DESCRIPTION OF PREFERRED EMBODIMENTS

EXAMPLE I

In the following example, the fatty acid is tall oil, and the amino-acid is aspartic acid. 1. Chloration of the tall oil.

In a closed bulb, 282g of tall oil is dissolved in 800 g of chloroform and a current of chlorine is passed through for 4.5 hours, the temperature of the bulb being maintained at −10°C. A flow of air is then passed through the mixture. The chloroform solution is then washed three times with 500 ml of water. The organic solution is dried on anhydrous sodium sulfate and then the chloroform is evaporated. There is then obtained 344 g of chlorated tall oil corresponding to a yield of 95% with respect to the initial tall oil.

2. Preparation of the chloride of the chlorated fatty acid.

To 360 g of chlorated tall oil in solution in 2 liters of hexane, there is added 174 g of phosphorus trichloride. The mixture is reacted under light reflux for 2.5 hours. After cooling, the reaction mixture is poured slowly on ice to decompose the excess non-reacted $PCl_3$. After washing in ice water, the organic solution is dried on anhydrous sodium sulfate. Then the hexane is evaporated. There is then obtained 359 g of the chloride of the acid, corresponding of a yield of 95% with respect to the initial chlorated tall oil.

3. Obtention of the amido-acid by condensation.

There is prepared in a first step, the sodium salt of aspartic acid by reacting aspartic acid with an excess of sodium hydroxide. Then to 177 g of the sodium salt of aspartic acid in solution in a 70–30 mixture of water and acetone, there is added dropwise 378 g of the chlorated tall oil chloride corresponding to the stoichiometric amount. The pH is maintained at a value of 10 during this addition by addition of necessary quantities of 2N sodium hydroxide. After two hours, the temperature is brought to 60°C. After cooling, the reaction mixture is diluted with 1,000 ml of water and acidified up to pH 1 with a solution of hydrochloric acid. The resulting amido-acid is then extracted by ether, dried on anhydrous sodium sulfate and filtered.

The ether is then evaporated. The yield of this condensation is 85% with respect to the sodium salt of the aspartic acid. There is recovered 435 g of the amido-acid at the end of the reaction.

4. Salification of the amido acid.

After measuring the acidity index according to ASTM D 974 - 64 (which leads to a value of 200 mg of potassium hydroxide per gram of pure amido-acid) there is added to the amido-acid a quantity of tiethanolamine 4 yimes greater than the stoichiometric amount necessary to obtain the salt. The quantity of neutralizing agent is not established in strict manner, it can vary within large limits, according to the properties that it is desired to confer on the product. For example, an excess of amine leads to an increase of the anti-corrosive power of the solutions.

There is shown at the end of Example III, the acidity index measured according to ASTM of the amido-acid; the amounts of chlorine and nitrogen effected on the amine salt of the pure amido-acid; the solubility in water, measured by the sedimented volume by centrifugation of an aqueous solution of the salt of the amido-acid at 5%; the minimum concentration of the salt of amido-acid in distilled water permitting the completion of the test for corrosion according to IP 125 (i.e. the obtention of the notation 0/0 – 0 according to this standard), the aqueous solution at 1% of amido-acid salt which is a measure of the lubrication power; and the biodegradability of a dilute aqueous solution of the amido-acid salt expressed by the relation ($BOD_5$/COD) in which $BOD_5$ represents the quantity of oxygen consumed biologically for 5 days and COD represents the quantity of oxygen necessary for complete oxidation of the solution.

EXAMPLE II

In this example, the fatty acid is oleic acid, the amino acid is a mixture of natural amino acids obtained by hydrolysis of proteins. The process of synthesis is identical to that which has been described in EXAMPLE I. Hereafter will be indicated the masses or the volumes of the reactants employed only when they are different from those of Example I.

1. Chloration of the oleic acid.

The chloration is effected with 282 g of oleic acid in solution in 800 g of chloroform. There is obtained at the end of the reaction 326 g of dichlorostearic acid which corresponds to a yield of 95%.

2. Preparation of the chloride of dichlorostearic acid.

The reaction is effected with 344 g of dichlorostearic acid in 2 liters of hexane. There is obtained at the end of the reaction 343 g of the chloride of dichlorostearic acid, corresponding to a yield of 95%.

3. Obtention of the amino acid by condensation.

There is prepared in a first step the sodium salt of the amino acid by reaction with an excess of sodium hydroxide. Then, to 125 g of the sodium salt of the amino acid in solution, in a mixture of water and acetone (70–30) are added dropwise 371 g of dichlorostearic acid chloride. There is recovered at the end of the reaction 395 g of amido-acid which corresponds to a yield of 85%.

4. Salification of the amido-acid.

The index of acidity of the pure amido-acid is equal to 80 mg of potassium hydroxide per gram of pure product. There is added a quantity of triethanolamine equal to four times the stoichiometric quantity necessary to obtain the salt.

EXAMPLE III

This example illustrates the synthesis of the amido acid salt starting from a non-chlorinated fatty acid. The fatty acid is oleic acid and the amino acid is aspartic acid.

1. Preparation of the chloride of the fatty acid.

282 g of oleic acid is reacted in two liters of hexane. At the end of the reaction there is obtained 285 g of the chloride of oleic acid which corresponds to a yield of 95%.

2. Obtention of the amido-acid by condensation.

There is prepared, in a first step, the sodium salt of aspartic acid. Then, to 177 g of the sodium salt of the amino acid in solution in a mixture of water and acetone (70–30) there is added, dropwise, 305 g of the chloride of the oleic acid. At the end of the reacton, there is recovered 278 g of amido-acid, which corresponds to a yield of 70%. 3. Salification of the amido-acid.

The index of acidity of the amido-acid is equal to 200 mg of potassium hydroxide per gram of product. A quantity of triethanolamine is added equal to four times the stoichiometric quantity necessary to obtain the salt.

There is shown in the table hereafter the results of the quantities and measurements of the properties of the amidoacid salts obtained in Examples I, II, and III. There is also shown by way of comparison, the results obtained with a commercial product "Cimcool S.4 Cincinnati".

TABLE I

| | Example I | Example II | Example III | Comparison Product |
|---|---|---|---|---|
| Acidity index (before salification mg KOH/g of amido acid | 200 | 100 | 200 | 2.5 (determined on the product as is) |
| Chlorine content (g/100 of amido acid) | 17.5 | 17.6 | 0.0 | 2.5 (determined on the product as is) |
| Nitrogen content (g/100 g of amido acid) | 1.90 | 3.10 | 2.45 | 0.32 (determined on the product as is) |
| Solubility in water; % by volume of sediment | 0 | 3 | 0 | 0 (solution at 5%) |
| Corrosion; minimum concentration non-corrosive in g of amido acid/ 100 g of solution (1) | 0.3 | 0.5 | 0.3 | 2 |
| Lubrication Power of the solution at 1% (amount of sodium hydroxide in kg) (2) | 200 | 200 | 160 | 126 (solution at 5%) |
| Biodegradability = | 15 | 12 | 10 | 6 |

TABLE I-continued

| | Example I | Example II | Example III | Comparison Product |
|---|---|---|---|---|
| $\frac{BOD_5}{COD} \times 100$ (4) | | | | |

(1) In this determination, there is employed an excess of amine of 7.5 times the stoichiometric quantity necessary for neutralization.
(2) Measurement is effected with an excess of amine (4 times the stoichiometric quantity).
(3) The product as is contains about 45% of active material.
(4) The measurement is effected with the triethanolamine salt in a quantity equal to two times stoichiometric.

EXAMPLE IV

This example is intended to illustrate the application for the obtaining of aqueous fluids for the working of metals from mixtures of salts of amido acids and salts of phosphoric esters of fatty alcohols or of fatty acid-alcohols such as described in copending Application of even date and in Italian application No. E.N. 30.279 A/73, filed October 18 in the name of the Applicants.

In the present example, the amido acid salt which is utilized is prepared from chlorated tall oil, N-dichlorostearoylaspartic acid and triethanolamine.

The salt of the phosphoric ester is the salt of triethanolamine and dichlororicinolphosphoric acid.

There is obtained from these two salts two mixtures A and B in water, which comprise (analyzed by functional criteria on the final obtained mixture):

| | Mixture A (% by weight) | Mixture B (% by weight) |
|---|---|---|
| N-dichlorostearoylaspartic acid | 3.9 | 3.9 |
| Dichlororicinophosphoric acid | 6.4 | 12.8 |
| Triethanolamine | 28.4 | 27.7 |
| Chlorated Tall Oil | 11.3 | 5.6 |
| Water | 49.0 | 49.0 |
| Sodium Nitrite | 1.0 | 1.0 |

There is shown in Table 2 the results of the quantities and the measures of certain properties of the mixtures obtained hereinabove, in comparison with the same control previously referred to (Cimcool S.4 Cincinnati).

TABLE II

| | Solution A | Solution B | Control |
|---|---|---|---|
| Amount of Chlorine (g/100 g of product) | 5.0 | 4.5 | 2.5 (determined on the product as is) |
| Amount of Nitrogen (g/100 g of product) | 2.80 | 2.77 | 0.32 (determined on the product as is) |
| Appearance of the aqueous solution | Limpid | Limpid | Limpid |
| Test 4 balls, standard ASTM D 2783 Quantity of sodium hydroxide in kg (solution at 5%) | 400 | 500 | 126 |
| Biodegradability = $\frac{BOD_5}{COD} \times 100$ | 14 | 12 | 6 |
| Corrosion test standard IP 125 Solutions at 4% | 0/0-0 | 0/0-0 | 0/0-0 |

Through the assembled results in the table, it is concluded that the mixtures of the salts of amido acids and of the salts of phosphoric esters constitute a good basis for the realization of aqueous fluids for the working of metals.

We claim:

1. An aqueous fluid for the working of metals comprising an aqueous solution of at least one salt of an amido acid of the formula:

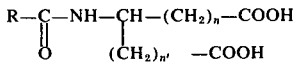

in which R is a hydrocarbon group substituted or not by chlorine, and having between 9 and 25 carbon atoms; n and n′ are whole numbers of zero, identical or not, whose sum (n + n′) is equal to 1 or 2.

2. An aqueous fluid as claimed in claim 1 further comprising in said solution, at least one salt of an ester selected from the group consisting of:

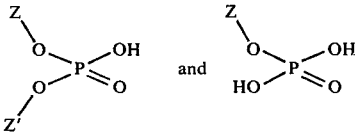

in which the groups Z and Z′ are identical or not, and include between 10 and 20 carbon atoms and including in addition a chlorine atom.

3. An aqueous fluid as claimed in claim 1 wherein the concentration of the salt in the aqueous solution is between about 10 and 70%.

4. An aqueous fluid as claimed in claim 1 wherein the concentration of the salt in the aqueous solution is between about 1 and 10%.

5. An aqueous fluid as claimed in claim 1 further comprising an additive selected from the group consisting of an anti-foam agent, a bactericide, an anti-corrosive agent, a colorant, an odor additive, and an agent modifying the physical characteristics of the aqueous solution.

6. An aqueous fluid as claimed in claim 1 wherein said salt is selected from the group consisting of an alkaline salt, an amine salt, an ammonium salt and mixtures thereof.

7. A mixture of salts consisting of at least one of the salts of an amido acid of the general formula:

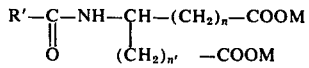

in which

R′ is hydrocarbon group substituted by chlorine and comprising nine to twenty-five carbon atoms, —$n$ and $n'$ are whole numbers or zero, identical or not, in which the sum $(n + n')$ is equal to 1 or 2.

—M is selected from the group consisting of alkali metals, the ammonium ion ($NH_4$) and substituted ammonium radicals derived from amines, and at least one salt of at least one orthophosphoric ester selected from the group consisting of:

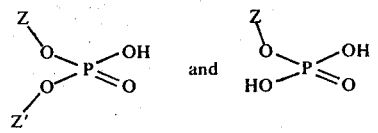

in which the groups Z and Z′ are identical or not, and include between 10 and 20 carbon atoms and including in addition a chlorine atom.

* * * * *